United States Patent [19]

Carpenter et al.

[11] Patent Number: 4,746,414

[45] Date of Patent: May 24, 1988

[54] ZERO DISCHARGE SPRAY RINSE SYSTEM FOR ELECTROPLATING OPERATIONS

[75] Inventors: Charles J. Carpenter, Panama City, Fla.; Winston de Monsabert, Camarillo, Calif.

[73] Assignee: The United States of America as represented by the Secretary of the Navy, Washington, D.C.

[21] Appl. No.: 96,572

[22] Filed: Sep. 8, 1987

[51] Int. Cl.[4] ..... C21D 21/06; C21D 21/08; C21D 21/20

[52] U.S. Cl. ..... 204/240; 204/241; 204/276; 204/DIG. 1; 204/DIG. 13

[58] Field of Search ..... 204/232, 235–236, 204/239, 240–241, 274, 276, DIG. 13, DIG. 1

[56] References Cited

U.S. PATENT DOCUMENTS

| | | | |
|---|---|---|---|
| 2,307,928 | 1/1943 | Hogaboom | 204/141.5 |
| 3,681,212 | 8/1972 | McKissick | 204/DIG. 13 X |
| 3,761,381 | 9/1973 | Yagishita | 204/238 |
| 3,979,220 | 9/1976 | Ishiyama et al. | 204/239 X |
| 4,302,319 | 11/1981 | Ueno | 204/238 |
| 4,561,956 | 12/1985 | Antonelli | 204/232 |

FOREIGN PATENT DOCUMENTS

| | | | |
|---|---|---|---|
| 0024929 | 2/1980 | Japan | 204/DIG. 13 |
| 2001101 | 1/1979 | United Kingdom | 204/DIG. 13 |

*Primary Examiner*—Donald R. Valentine
*Attorney, Agent, or Firm*—Joseph M. St. Amand

[57] ABSTRACT

The zero discharge spray system comprises a tank for collecting and storing rinse water, a set of spray nozzles aligned within the tank, and a pump for both pumping used rinse water through the spray nozzles and/or to the plating bath as makeup for evaporation. A timer level control system maintains the plating bath level and the rinse tank level, and limits the nozzles spray time. The system also includes a fresh water spray for final rinse of plated parts. By using a controlled spray rinse system which reduces the amount of water added to the system so as not to exceed that lost by evaporation, no contaminated rinse water is discharged as waste.

20 Claims, 1 Drawing Sheet

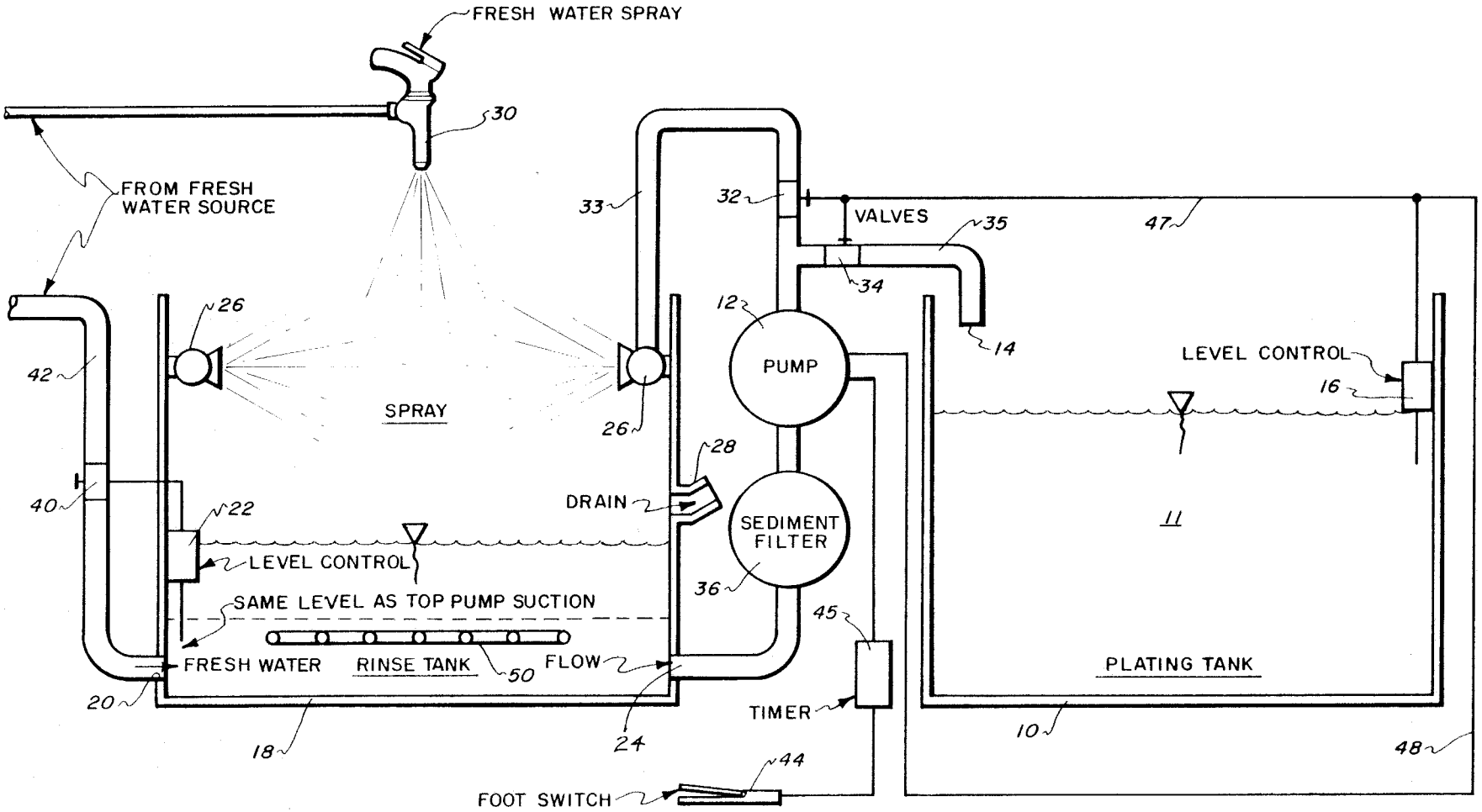
FRESH WATER SPRAY
30
FROM FRESH WATER SOURCE
42
40
26
SPRAY
33
32
VALVES
35
34
47
12
PUMP
14
LEVEL CONTROL
16
11
48
PLATING TANK
10
28
DRAIN
36
SEDIMENT FILTER
45
TIMER
44
FOOT SWITCH
24
FLOW
50
RINSE TANK
SAME LEVEL AS TOP PUMP SUCTION
LEVEL CONTROL
22
FRESH WATER
18
20

ZERO DISCHARGE SPRAY RINSE SYSTEM FOR ELECTROPLATING OPERATIONS

BACKGROUND OF THE INVENTION

1. Field of the Invention

The present invention relates to electroplating processes and more particularly to the elimination or reduction of discharge of the rinses from electroplating operations which are normally discharged to industrial waste for treatment.

2. Description of the Prior Art

Prior methods use a dip-rinse technology for plated part cleaning by diffusion and some form of effluent clean-up. The prior methods use conventional dilution type rinses, either free flow or countercurrent, which use the principle of immersing the electroplated part in water to allow the "drag out" to be diluted from the part. The normal free flow rinses are then discharged to industrial waste for treatment. Hard chrome plating operations, for example, have a major problem with water usage. Large volumes of water with low concentrations of chrome are not economically recoverable by standard recovery processes. Frequently the problem is compounded by mixing the rinse waters from a variety of metal finishing operations. The elimination or reduction of the need to discharge the rinses to industrial waste and the elimination of high treatment costs provide significant savings, as well as provide a reduction in environmental pollution.

SUMMARY OF THE INVENTION

The present invention helps to solve the problems of prior art methods by eliminating the need to discharge rinse waters from the electroplating process to industrial waste. A spray system is used which results in water reduction and in waste discharge elimination.

The improved system uses spray rinsing which operates on the impact principles, where drops of contaminators from the plating operation are "knocked" off the plated parts being rinsed by the impact of the rinse water being sprayed. This process uses only approximately 15% of the water that is normally required for a dilution rinse. First, a recirculation initial spray rinsing of plated parts using contaminated (i.e. used) rinse water is done, followed by a final fresh water spray rinse, and all spray water falls back into the rinse tank. From the rinse tank the returned spray water is recirculated for initial spraying purposes and/or pumped to the plating tank to help make up for water lost by evaporation in the plating bath. In sensitive electroplating baths, use of distilled water may be desired if return of the rinse water to the plating bath tank is contemplated. Otherwise, all water from the rinse operation is reused in the initial rinsing operations and in the plating bath. In a rinse system where drag-out may be returned to the source (e.g. a chrome plating operation where evaporation losses out of the plating bath can be made up from rinse water), this system eliminates discharge to sewer as well as reduces water usage.

Other objects, advantages and novel features of the invention will become apparent from the following detailed description of the invention when considered in conjunction with the accompanying drawing.

BRIEF DESCRIPTION OF THE DRAWING

The FIGURE of drawing is a schematic diagram of a preferred embodiment of the invention showing a general arrangement of equipment for electroplating and rinse operations.

DESCRIPTION OF THE PREFERRED EMBODIMENT

The apparatus, as shown in the figure of drawing, comprises a plating tank 10 containing a plating bath solution 11 which can be replenished with water via pump 12 and inlet 14. A level control 16 in the plating tank is activated by the level of the plating bath 11. A rinse tank 18 includes: a freshwater inlet 20, a level control 22, water outlet 24 to the pump 12, and a plurality of spray nozzles 28 positioned about the upper portion of the tank in an area where plated items are rinsed off, above an overflow drain 28. Freshwater enters rinse tank 18 through inlet 20 near the tank bottom. Inlet 20 includes a screen, not shown, to keep out large solids and to prevent them from subsequently entering the pump piping at 24. A freshwater spray 30 is positioned above the area for plated items to be rinsed and preferably is a hand held spray unit although a movably mounted or other suitable freshwater spray unit can be used.

Water is maintained in rinse tank 18 at a level above that of outlet 24, the intake to pump 12. A solenoid valve 32 in line 33 between pump 12 and the spray nozzles 26 is normally in the open position. Solenoid valve 32 is electrically connected to and is activated to the closed position by level control 16 in the plating tank when the level in the plating tank drops below a predetermined level. Solenoid valve 34 in line 35 to inlet 14 is normally in the closed position; this valve is simultaneously activated to its open position, along with the closing of valve 32 and actuation of pump 12, by level control 16 when the level in plating tank 10 drops below the present level.

The contaminated rinse water, which contains plating solution, etc., is pumped out of rinse tank 18 by pump 12 through a sediment filter 36. While in the normal mode, with solenoid valve 32 open and solenoid valve 34 closed, water is pumped from tank 18 via line 33 and through spray nozzles 26 of the spray system where it eventually falls back into the rinse tank. Sediment filter 36 located between intake 24 and pump 12 is one which is resistant to corrosion by the material being pumped. This filter needs to be one that is capable of removing all solids that would interfere with plating operations if returned to the plating tank. The sediment filter should be changed regularly so as not to interfere with flow rates.

Fresh water is used as a final rinse through the freshwater spray unit 30; this water following use also falls back into the rinse tank. Level control 22 maintains the level in the rinse tank 18 on a system basis where evaporation in the system accounts for more water than freshwater spray 30 adds to tank 18. Level control 22 operates to open solenoid valve 40 in freshwater line 42 when the water level in the rinse tank drops close to the top of the freshwater inlet 20. Solenoid valve 40, which is normally in the closed position, then allows fresh water through intake 20 until the preset high water level is reached. The freshwater intake 20 to the rinse tank should be located as far from overflow drain 28 as possible.

The spraying system is preferably controlled by a foot switch 44, for example, although any suitable switch control can be used. Switch 44 operates to activate a timer 45. A waterproof foot switch 44 can conveniently be placed on the floor for activating timer 45 into its cycle for turning on pump 12. Timer 45 is an electrical timer and can be set for a desired time period (e.g. 0 to 3 minutes) to allow power to pump 12 for a preset time (usually 30 seconds) to activate the spray system nozzles 26.

Plating tank evaporation losses are made up from the rinse system. Level control 16 in plating tank 10 is adjusted so that the level in the plating tank can drop to accommodate the entire volume of the rinse tank (from the rinse tank full level near the top of control 22 to a point just slightly above outlet 24 to pump 12). When level control 16 activates, an electrical signal via line 47 causes valve 32 to close (taken out of its normal mode) and causes valve 34 to open to allow water to be pumped from rinse tank 18 into the plating tank. Level control 16 simultaneously activates pump 12 via line 48, along with valves 32 and 34. If the pump is activated for pumping water from tank 18 to tank 10 while the plater desires to rinse a part, then the plater would use all fresh water from spray unit 30, without using the nozzles 26 during the time while plating tank 10 is being filled.

The type of pump used depends upon the number of spray nozzles (gal/min), pipe losses, material pumped (corrosive or not, etc.), pressure desired, and its position relative to the rinse tank. In general, the pump 12 should be able to maintain 20 psi, for example, throughout the system. The pump can be either self priming or positioned to operate without priming, and should be resistant to corrosive materials, etc. being pumped. Generally, a centrifugal pump appears to be best for maintaining a constant pressure.

Several types of spray nozzles can be used in the spray system simultaneously. Best results appear to be from nozzles that provide a full cone spray pattern, such as a 50 degree cone pattern that provides 1.3 gallons of rinse at 20 psi, for example.

The placement of the spray nozzles 26, the number of nozzles used, and the most efficient cone pattern for efficient rinsing will depend on the size of the rinse tank being used. Generally, the nozzles should be placed so that the cone pattern of the sprays overlap in the center of the rinse tank, and take up most of the area within the tank. Nozzles 26 should be located sufficiently below the top of the tank to prevent misting above the tank. Line pressure is basically limited by the conditions which cause misting.

Freshwater feed 20 can be located higher than overflow drain 28; however, when feed 20 is below the liquid level of tank 18, line 42 should include a one-way valve to prevent backflow in the event of a pressure loss in the supply line. Freshwater sprayer unit 30 is preferably a hand held spray gun, although a movably mounted spray nozzle unit can be used. Any convenient spray pattern can be provided by sprayer unit 30, although a full cone spray appears to work best. For example, a spray gun nozzle using 3.1 gal/min of water at 40 psi with a 50 degree cone pattern operates very satisfactorily for the final rinsing of most plated items.

The plating tank level control 16 operates valves 32 and 34 and is also used to start pump 12 to discharge its flow for making up the plating tank. Level control 16 is adjusted to activate the valves 32 and 34, and pump 12, when the level in the plating tank to be made-up is equal to the amount of water normally contained in the rinse tank above the level of intake 24 to the pump. This allows for the most concentrate to be replaced.

The rinse tank overflow drain 28 is placed at about the upper limit of the liquid level desired in the rinse tank. A slight increase in elevation of drain 28 at the outside of tank 18 is preferred to prevent accidental loss of liquids due to splash or spray.

This spray system is particularly useful for hard chrome plating operations. It is a zero discharge system, where all rinse water is returned to the plating bath to make up for evaporation losses. The spray system works well on all plating baths where the temperature is high enough to provide evaporation losses sufficient to allow use of all the rinse water as plating bath replacement water, such as with a nickel plating bath.

Variations to the system are possible. On plating baths where there is little evaporation, the spray rinse system can be used to dramatically reduce water usage. In this type of situation the level control 22 in the rinse tank is changed to a conductivity probe, and drain 28 is located at the highest level desired. When the rinse water has been contaminated sufficiently, the conductivity probe will then activate solenoid valve 40 and allow fresh water to enter at the freshwater intake 20 and highly contaminated water to exit through drain 28. Solenoid valves 32 and 34 along with the return inlet 14 to the plating tank will not be used or needed if no flow of the used rinse water to the plating is desired, and could be inactivated or eliminated.

Other variations to the rinse system can include a chill system if the rinse is to contain volatile liquids. The chill system can be used to minimize losses on the spray cycle. In addition, a heating system can be used, if desired, for providing a hot rinse. In this case a heat exchanger 50 can be included within the rinse tank for providing either cooling or heating of the liquid in the rinse tank.

Obviously many modifications and variations of the present invention are possible in the light of the above teachings. It is therefore to be understood that within the scope of the appended claims, the invention may be practiced otherwise than as specifically described.

What is claimed is:

1. An electroplating system for eliminating the discharge of contaminated rinse water to industrial waste for treatment, comprising:

(a) a plating tank means for containing a plating bath;

(b) a rinse tank means for containing rinse water;

(c) said rinse tank means including a freshwater inlet means, a rinse water outlet, an overflow drain, a first control means, and a spray rinsing system;

(d) said spray rinsing system including an initial spray means using rinse water from said rinse tank for initially rinsing plated parts, and a final spray means using fresh water from a freshwater source for finally rinsing plated parts; sprayed rinse water from said initial spray means and from said final spray means falling back into said rinse tank means for reuse;

(e) a pump means operable to pump rinse water from said rinse tank for use in said initial spray means for rinsing plated parts and alternatively to said plating tank for adding make up water to the plating bath;

(f) valve means operable to direct water flow from said pump means to either of said initial spray means and said plating tank means bath;

(g) switch means for normally activating said pump means to pump rinse water to said initial spray means;

(h) a second control means located in said plating tank means; said second control means operable to be activated by the level of the bath in said plating tank means for actuating said valve means and said pump means to cause rinse water to be pumped to said plating tank means for adding water as needed to said plating bath to make up for evaporation losses;

(i) said first control means being operable to actuate a freshwater valve means to allow fresh water to flow into said rinse tank means for maintaining the level of the rinse water in said rinse tank means above the level of said rinse water outlet;

wherein, under normal operations, freshwater added to the system for spraying operations will not exceed the amount of water lost by evaporation in the system, and no rinse water is discharged to waste.

2. A system as in claim 1 wherein filter means is used to prevent harmful solid materials from entering the system and said pump means includes sediment filter means.

3. A system as in claim 1 wherein a timer means is included for controlling the length of the initial spray rinse.

4. A system as in claim 1 wherein heat exchanger means is included for heating the rinse water to provide a hot rinse when needed and for chilling the rinse water to minimize losses where volatile liquids are used in the spray cycles.

5. A system as in claim 1 wherein said initial spray means includes a plurality of spray nozzles positioned within the rinse tank means above the level of rinse water in the rinse tank means.

6. A system as in claim 5 wherein each of said spray nozzles provides a full cone spray pattern.

7. A system as in claim 5 wherein said spray nozzles are positioned sufficiently below the top of said rinse tank means to prevent misting above said rinse tank means.

8. A system as in claim 1 wherein said final spray means comprises a movable spray unit having at least one spray nozzle.

9. A system as in claim 8 wherein said final spray means is a hand held unit.

10. In an electroplating system having plating and rinsing operations, rinsing apparatus for substantially eliminating contaminated rinse water having to be discharged to industrial waste for treatment, comprising:

(a) rinse tank means for containing rinse water;

(b) said rinse tank means including a freshwater inlet means, a rinse water outlet, an overflow drain, a control means, and a spray rinsing system;

(c) said spray rinsing system including an initial spray means using rinse water from said rinse tank means for initially rinsing plated parts, and a final spray means using fresh water from a freshwater source for finally rinsing plated parts; sprayed rinse water from said initial spray means and from said final spray means falling back into said rinse tank means for reuse;

(d) pump means operable to pump rinse water from said rinse tank via said rinse water outlet to said initial spray means for rinsing plated parts;

(e) valve means operable to allow fresh water from a freshwater source to enter said rinse tank means;

(f) switch means for normally activating said pump means to pump rinse water from said rinse tank means to said initial spray means;

(g) said control means being operable to sense the degree of contamination of the rinse water in said rinse tank means and to activate said valve means at a predetermined degree of contamination to cause fresh water to flow into said rinse tank means for maintaining the rinse water in said rinse tank means below a desired maximum degree of contamination;

wherein, freshwater added to the system for spraying operations is substantially reduced, thereby greatly reducing any amount of rinse water discharged to waste.

11. A system as in claim 10 wherein said control means comprises a conductivity probe.

12. A system as in claim 10 wherein filter means is used to prevent harmful solid materials from entering the system and said pump means includes sediment filter means.

13. A system as in claim 10 wherein a timer means is included for controlling the length of the initial spray rinse.

14. A system as in claim 10 wherein heat exchanger means is included for heating the rinse water to provide a hot rinse when needed and for chilling the rinse water to minimize losses where volatile liquids are used in the spray cycles.

15. A system as in claim 10 wherein said initial spray means includes a plurality of spray nozzles positioned within the rinse tank means above the level of rinse water in the rinse tank means.

16. A system as in claim 15 wherein each of said spray nozzles provides a full cone spray pattern.

17. A system as in claim 15 wherein said initial spray nozzles are positioned sufficiently below the top of said rinse tank means to prevent misting above said rinse tank means.

18. A system as in claim 1 wherein said final spray means comprises a movable spray unit having at least one spray nozzle.

19. An electroplating system for eliminating the discharge of contaminated rinse water to industrial waste for treatment, comprising:

(a) plating tank means for containing a plating bath;

(b) rinse tank means for containing rinse water;

(c) said rinse tank means including freshwater inlet means and rinse water outlet means located near the bottom of said rinse tank means, an overflow drain, a first level-control means, and a spray rinsing system;

(d) said spray rinsing system including an initial spray means using rinse water from said rinse tank means for initially rinsing plated parts, and a final spray means using fresh water from a freshwater source for finally rinsing plated parts; sprayed rinse water from said initial spray means and from said final spray means falling back into said rinse tank means for reuse;

(e) pump means operable to selectively pump rinse water from said rinse tank means via said rinse water outlet for use in said initial spray means for rinsing plated parts and alternatively to said plating tank means for adding make up water to the plating bath;

(f) valve means operable to direct water flow from said pump means to either of said initial spray means and said plating tank means bath;

(g) switch means for normally activating said pump means to pump rinse water to said initial spray means;

(h) a second level-control means located in said plating tank means; said second level-control means operable to be activated by the level of the bath in said plating tank means for activating said valve means and said pump means to cause rinse water to be pumped to said plating tank means for adding water as needed to said plating bath to make up for evaporation losses;

(i) said valve means comprising a normally open first water valve connected between said pump means and said initial spray means and a normally closed second water valve connected between said pump means and said plating tank means, whereupon activation by said second level-control means said first water valve is closed and second water valve is opened;

(j) said first level-control means being operable to cause fresh water to flow into said rinse tank means for maintaining the level of the rinse water in said rinse tank means above the level of said rinse water outlet;

wherein, under normal operations, freshwater added to the system for spraying operations will not exceed the amount of water lost by evaporation in the system, and no rinse water is discharged to waste.

20. A system as in claim 19 wherein heat exchanger means is included in said rinse tank means for heating the rinse water to provide a hot rinse when needed and for chilling the rinse water to minimize losses where volatile liquids are used in the spray cycles.

* * * * *